US012391433B2

(12) United States Patent
Gaspar

(10) Patent No.: US 12,391,433 B2
(45) Date of Patent: Aug. 19, 2025

(54) BEVERAGE ACCESSORY AND METHOD OF USING SAME

(71) Applicant: Paul Gaspar, Point Pleasant, NJ (US)

(72) Inventor: Paul Gaspar, Point Pleasant, NJ (US)

( * ) Notice: Subject to any disclaimer, the term of this patent is extended or adjusted under 35 U.S.C. 154(b) by 88 days.

(21) Appl. No.: 18/323,927

(22) Filed: May 25, 2023

(65) Prior Publication Data

US 2023/0294877 A1 Sep. 21, 2023

Related U.S. Application Data

(63) Continuation of application No. PCT/US2021/060705, filed on Nov. 24, 2021.

(51) Int. Cl.

| | |
|---|---|
| ***B65D 23/10*** | (2006.01) |
| ***A47G 23/02*** | (2006.01) |
| ***B65D 23/06*** | (2006.01) |

(52) U.S. Cl.

CPC ..... *B65D 23/104* (2013.01); *A47G 23/0241* (2013.01); *B65D 23/065* (2013.01)

(58) Field of Classification Search

CPC . B65D 23/104; B65D 23/065; A47G 23/0241

See application file for complete search history.

(56) References Cited

U.S. PATENT DOCUMENTS

| | | | | |
|---|---|---|---|---|
| 3,202,309 | A * | 8/1965 | Simpson | A47G 23/0241 215/396 |
| D287,093 | S * | 12/1986 | Ryan | D32/46 |
| 2008/0151529 | A1* | 6/2008 | Zell | G01N 33/146 362/96 |
| 2019/0002261 | A1* | 1/2019 | Kole | B65D 23/104 |
| 2020/0223587 | A1* | 7/2020 | DiCarlo | A47G 23/0241 |

* cited by examiner

*Primary Examiner* — Shawn M Braden

(74) *Attorney, Agent, or Firm* — SLEMAN & LUND LLP

(57) ABSTRACT

A bottle accessory includes a thermoplastic or thermoset body including a circumferentially continuous collar configured and arranged to sit about a neck of a bottle, and a flared end configured and arranged to extend down one side of the bottle, the flared end including at least one feature forming a grip portion.

16 Claims, 8 Drawing Sheets

BEVERAGE ACCESSORY AND METHOD OF USING SAME

CROSS-REFERENCE TO RELATED APPLICATIONS

This application is a continuation of International Application Serial No. PCT/US21/60705, filed Nov. 24, 2021, and claims priority to U.S. Provisional Application Ser. No. 63/118,154, filed Nov. 25, 2020, entitled "BEVERAGE ACCESSORY AND METHOD OF USING SAME," the contents of both of which are fully incorporated as if fully set forth herein.

FIELD OF THE DISCLOSURE

The present disclosure relates to devices and methods for serving beverages. More particularly the present disclosure relates to devices that couple to a bottle to aid in opening, holding, serving, containing and/or branding a beverage.

BACKGROUND OF THE DISCLOSURE

Beverages are often served in bottles, such as glass bottles. These bottles may come in various shapes and/or sizes, and in some cases, the shape of the bottle signals its contents. There are several common variations. For example, Bordeaux bottles are some of the most popular and have distinctively high shoulders and straight sides. Burgundy bottles have sloping shoulders and are generally used for Pinot Noir and Chardonnay. Alsace bottles are tall and slender. Sparkling wine bottles, such as those used for Champagne, have a rounded shoulder and a deep dimple at the bottom known as a "punt". Port bottles are similar to Bordeaux bottles with high shoulders. Dessert bottles are often tall and thin. In addition to these traditional shapes, other shapes are also possible, including shapes for other alcoholic and non-alcoholic beverages.

Many of these bottles are difficult to hold or manipulate while serving. Additionally, the beverage may often drip down the side of the bottle while or after serving. Thus, it would be desirable to create accessories to aid in serving beverages from bottles.

SUMMARY OF THE DISCLOSURE

In some examples, a bottle accessory includes a thermoplastic or thermoset body comprising a cylindrical portion and a cone-shaped portion, the cylindrical portion having an inner wall, an outer wall, and a well defined by the inner wall and the outer wall, and an absorbent ring disposed within the well.

BRIEF DESCRIPTION OF THE DISCLOSURE

Figure 5A:
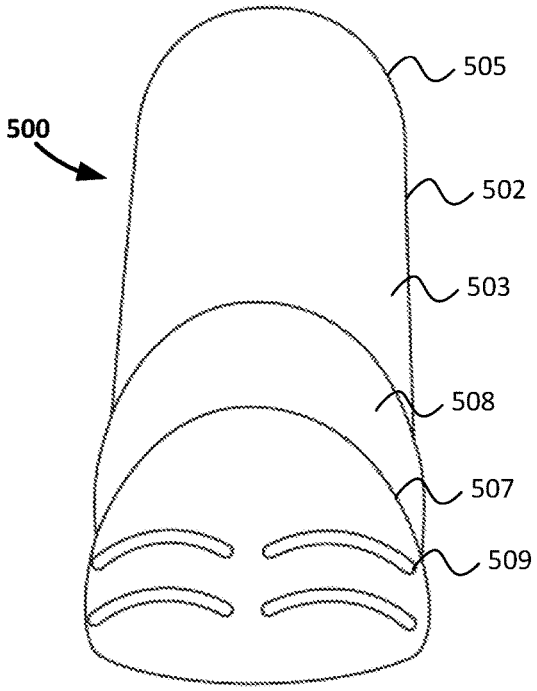
Figure 5B:
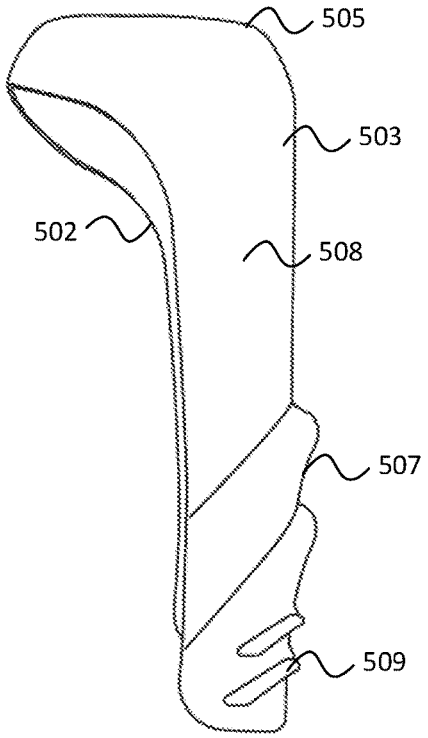
Figure 5C:
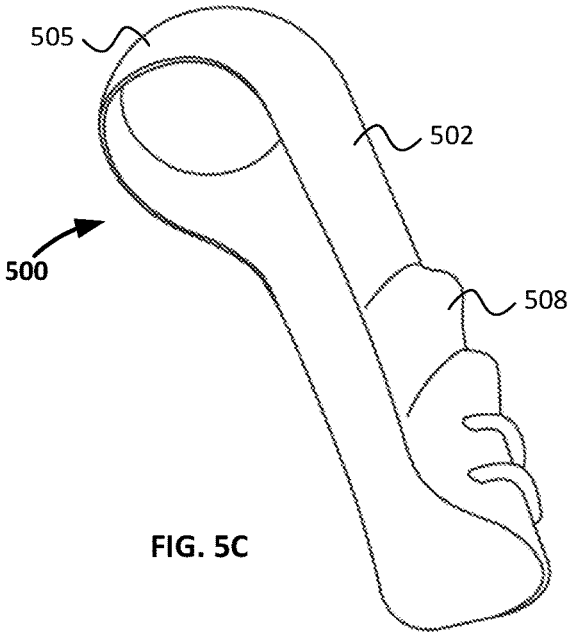
Figure 6A:
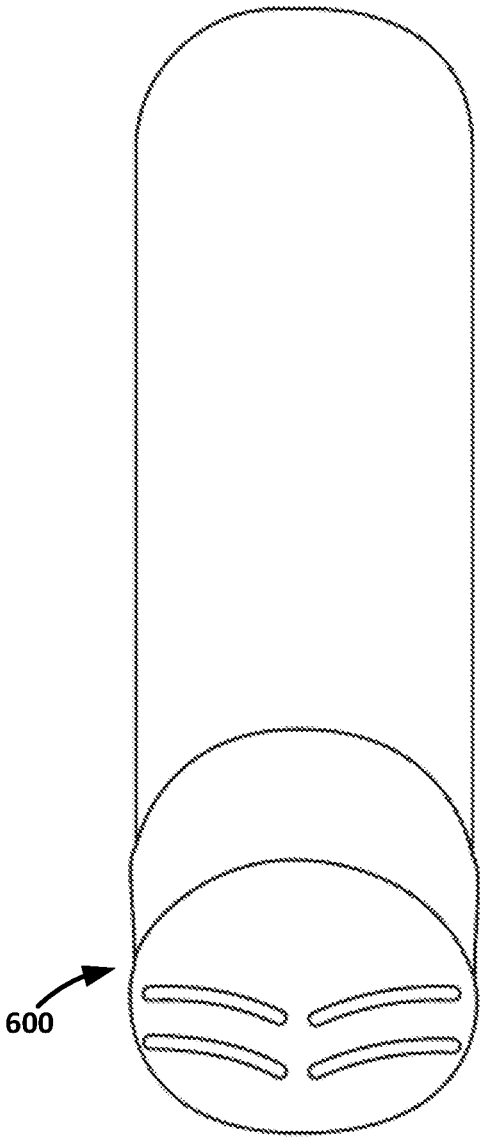
Figure 6B:
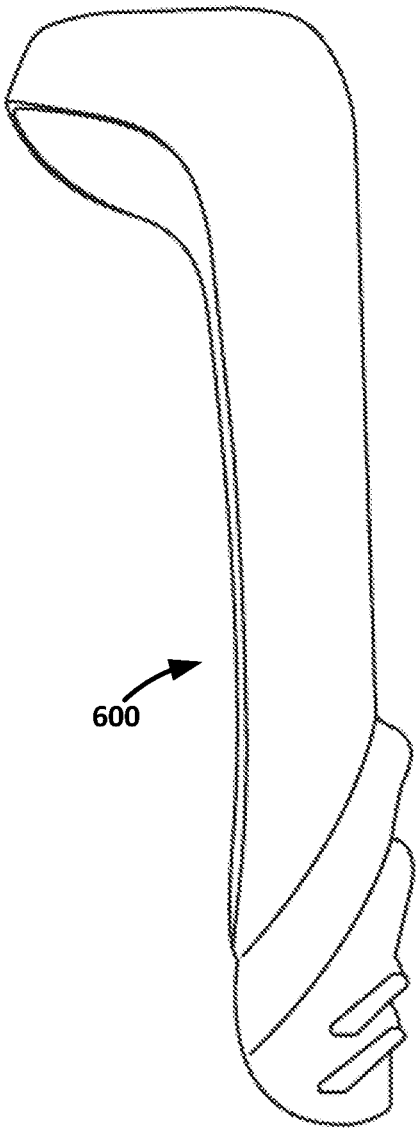

Various embodiments of the presently disclosed bottle accessories are disclosed herein with reference to the drawings, wherein:

FIGS. 1A-F illustrate an example of a bottle accessory according to one embodiment of the disclosure;

FIGS. 2A-E illustrate an example of a bottle accessory according to a second embodiment of the disclosure;

FIGS. 3A-D illustrate an example of a bottle accessory according to a third embodiment of the disclosure;

FIGS. 4A-D illustrate an example of a bottle accessory according to a fourth embodiment of the disclosure;

FIGS. 5A-C illustrate another example of a bottle accessory according to a fifth embodiment of the disclosure; and FIG. 6A-B illustrate another example of a bottle accessory according to a sixth embodiment of the disclosure.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made in the beverage industry, conventional devices and methods suffer from certain shortcomings such as those discussed above.

There therefore is a need for further improvements to the devices and methods used to serve beverages. Among other advantages, the present disclosure may address one or more of these needs.

FIGS. 1A-F illustrate a first embodiment of the disclosure wherein a bottle accessory 100 includes a drip catcher A1. Bottle accessory 100 generally includes an elongated body 102. Body 102 may be formed of a thermoplastic or thermoset material such as silicone, TPE, various plastics, elastomers and/or metals, and may be formed by injection molding or any other suitable manufacturing technique. In some examples, body 102 is formed of an elastomeric material. In some examples, the elongated body 102 includes a generally cylindrical portion P1 and a tapered portion P2, the tapered portion P2 having a sidewall 103 with a gradually narrowing diameter. The wider end of the body 102 may be disposed adjacent the open end of a bottle, while the narrower end of the body 102 may be disposed closer to the bottom of a bottle. As shown, the cylindrical portion P1 includes a dual-wall configuration in which the body forms an inner wall 104, an outer wall 106, and a well 105 defined between the inner wall and the outer wall. In at least some examples, well 105 has a width defined as the distance between the inner and outer walls, and a height that is suitable to accept another element.

Figure 1A:
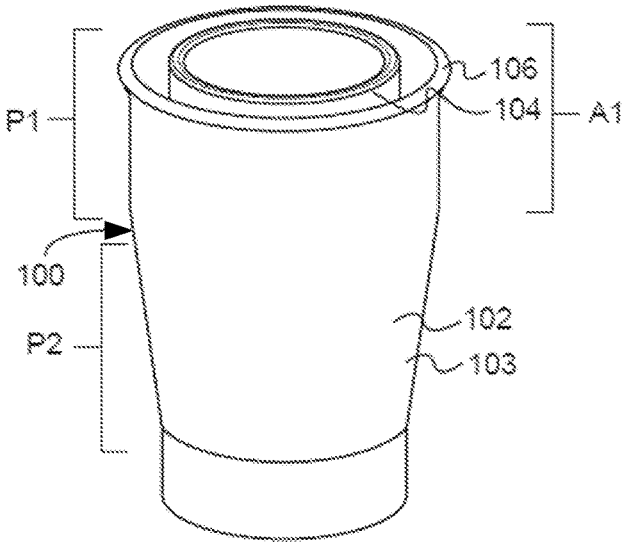
Figure 1B:
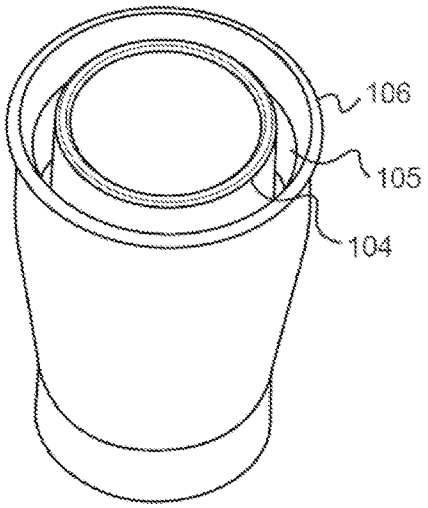
Figure 1C:
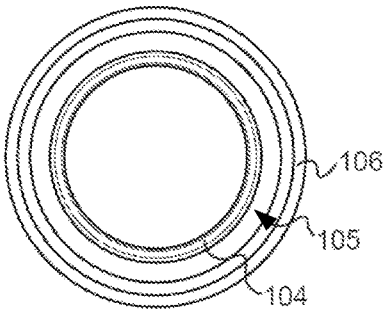
Figure 1D:
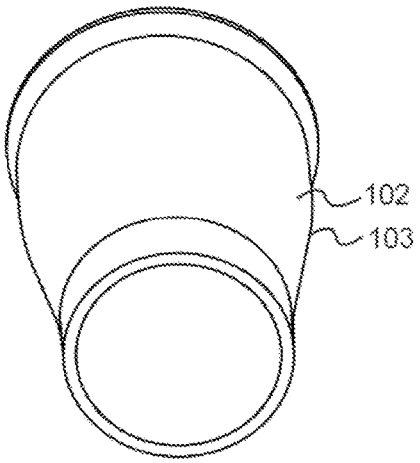
Figure 1E:
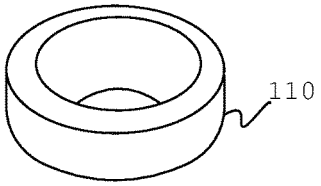

Well 105 may be a void configured and sized to accept an absorbent ring 110 that fits snugly within the cylindrical well (FIG. 1E). Absorbent ring 110 may be formed of a liquid-absorbent material such as a sponge, foam, felt, cotton, etc. In at least some examples, absorbent ring 110 is disposable, reusable and/or washable. Alternatively, absorbent ring 110 may be cleaned and reused. As shown, absorbent ring 110 is generally cylindrical and complements the shape of the well. It will be understood that the well 105 itself may have different shapes (e.g., the well may be cone-shaped and have a narrowing diameter instead of a cylinder), and that the absorbent ring 110 may be modified to have a complementary shape to fit within the various well voids (e.g., cone-shaped, cylindrical, absorbent material, etc.).

Figure 1F:
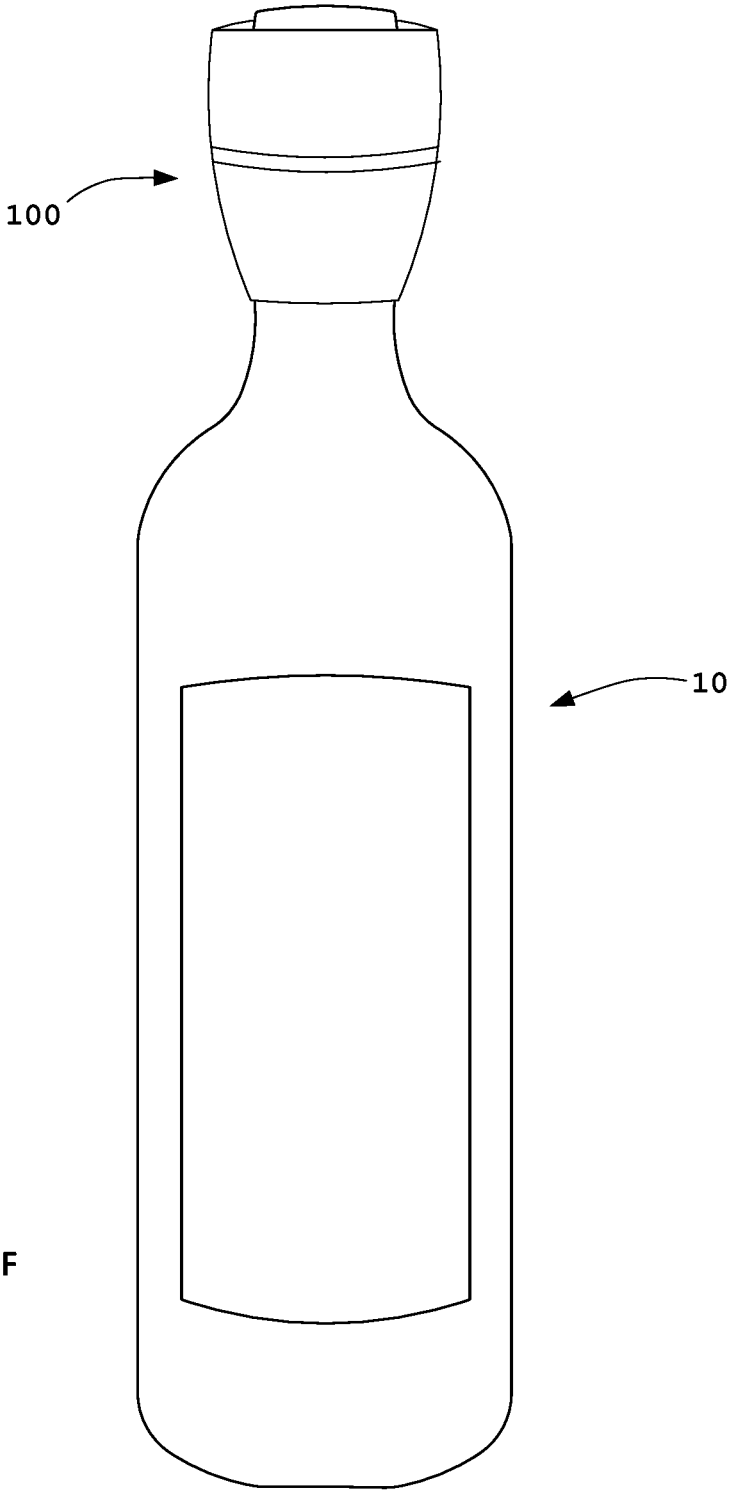

FIG. 1F illustrates bottle accessory 100 as it fits onto a bottle 10. As shown, the accessory 100 fits adjacent the opening of the bottle around the bottle's neck region. Body 102 of accessory 100 may be elastomeric so that it provides a tight, fluid seal around the bottle and prevent liquid from passing between the accessory 100 and the bottle. The bottle may be tilted to serve the beverage and the bottle accessory 100 may catch dripping liquid that runs down the side of the bottle. Specifically, liquid that drips down the side of the bottle will be led into well 105 where it will be absorbed by absorbent ring 110. After the bottle is empty, the bottle accessory 100 may be removed from the bottle and reused.

Figure 2A:
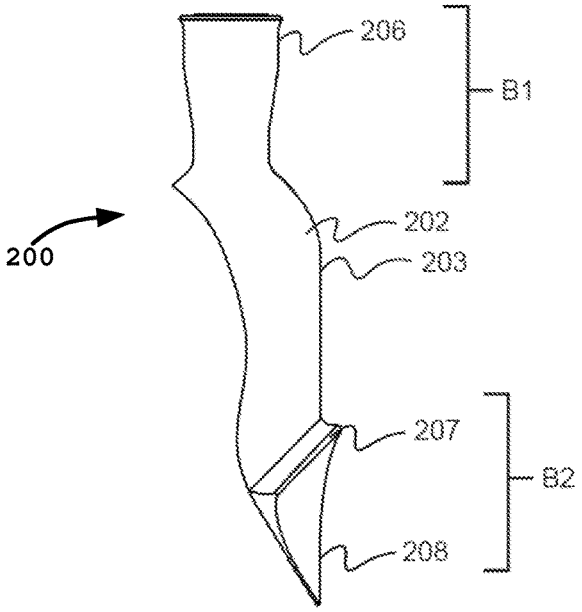
Figure 2B:
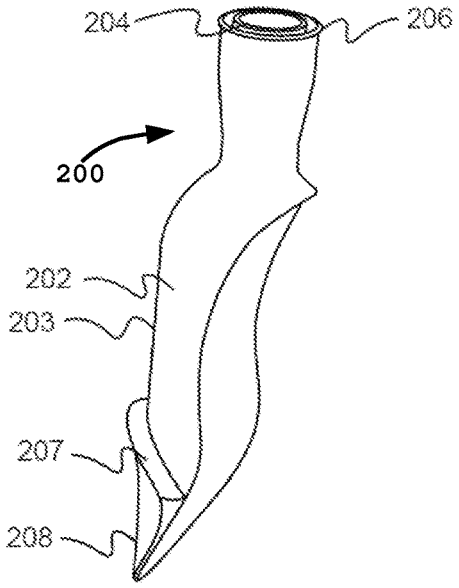
Figure 2C:
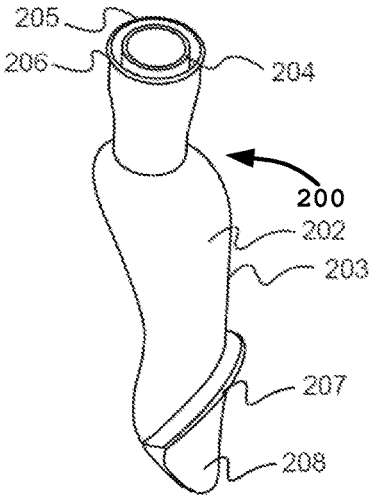
Figure 2D:
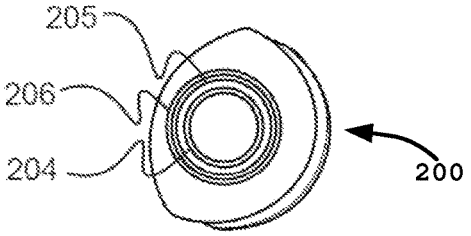
Figure 2E:
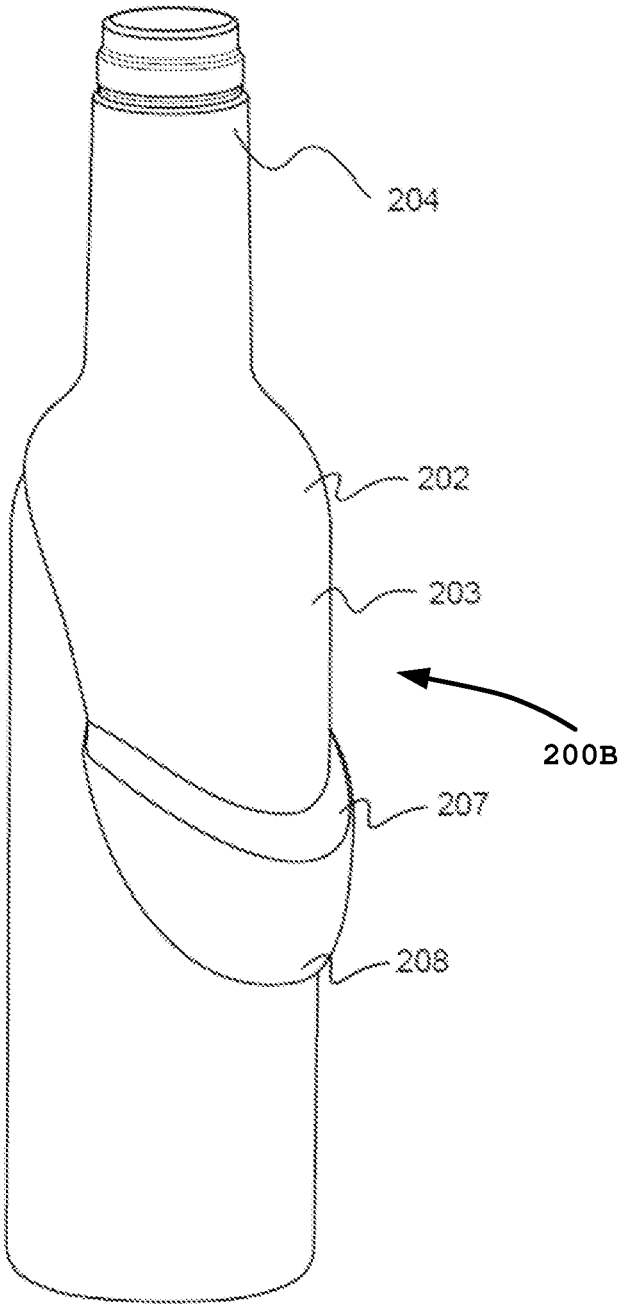

FIGS. 2A-D illustrate another embodiment of a bottle accessory 200. In this example, accessory 200 includes a body 202 having a sidewall 203, an inner wall 204, an outer wall 206 and a well 205 to serve as a drip catcher B1 similar to that described with reference to FIGS. 1A-F. Body 202 may be formed of any of the materials discussed above. In this embodiment, body 202 is extended down the side of the bottle along one side to include a flared end 208, the body 202 forming a hollow shell that complements the shape of a bottle. Flared end 208 may extend down the side of the body close to the bottom of a bottle. In this example, body 202 may incorporate a semi-annular, rim 207 forming a grip portion B2 adjacent the flared end 208 and projecting out from the body so that a user's fingers can manipulate the bottle. Grip portion B2 may allow for the fore, middle, ring, and/or pinky fingers to pull on opposing direction to the thumb which sits in the punt of the bottle to hold the bottle in tension therebetween. Though accessory 200 has been shown with both the drip catcher B1 and the grip portion B2, it will be understood that embodiments are possible that only incorporate one of these features. For example, FIG. 2E illustrates an accessory 200B that incorporates the grip portion only, but not the drip catcher.

Figure 3A:
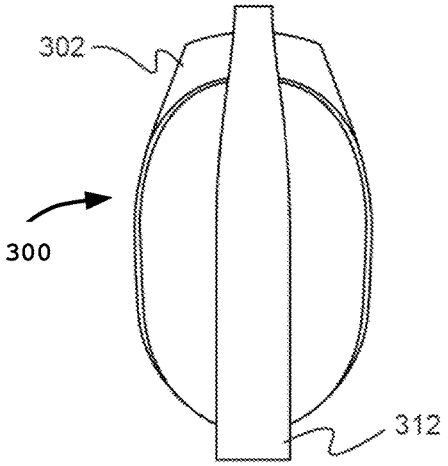
Figure 3B:
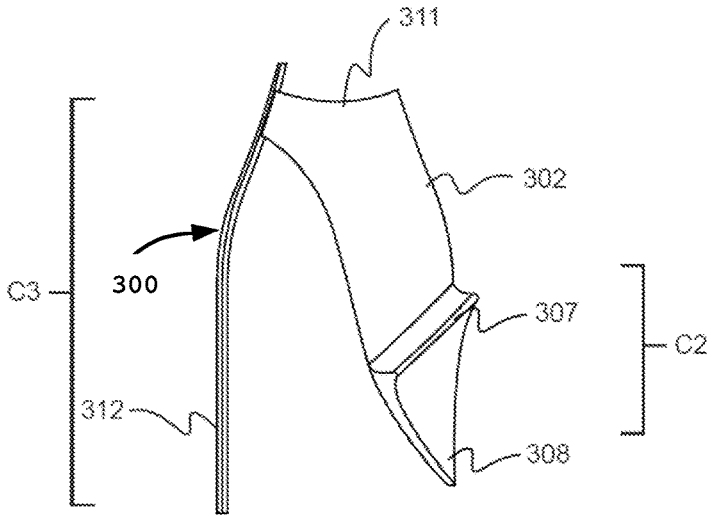
Figure 3C:
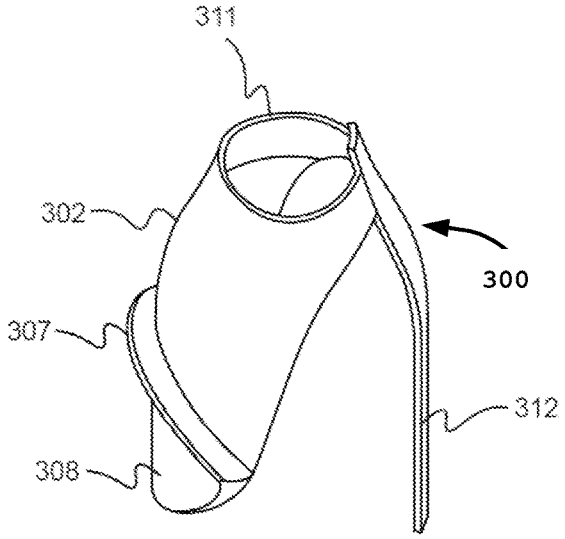
Figure 3D:
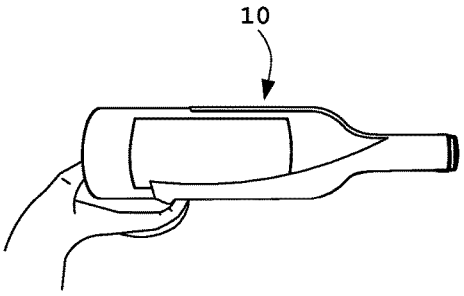
Figure 4A:
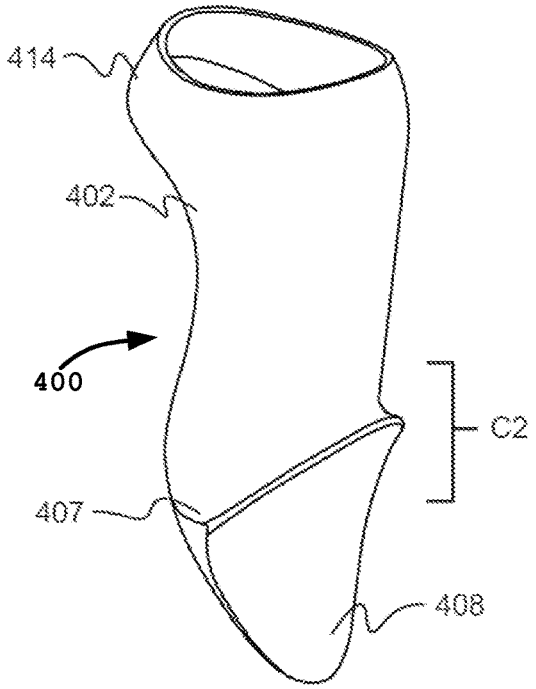
Figure 4B:
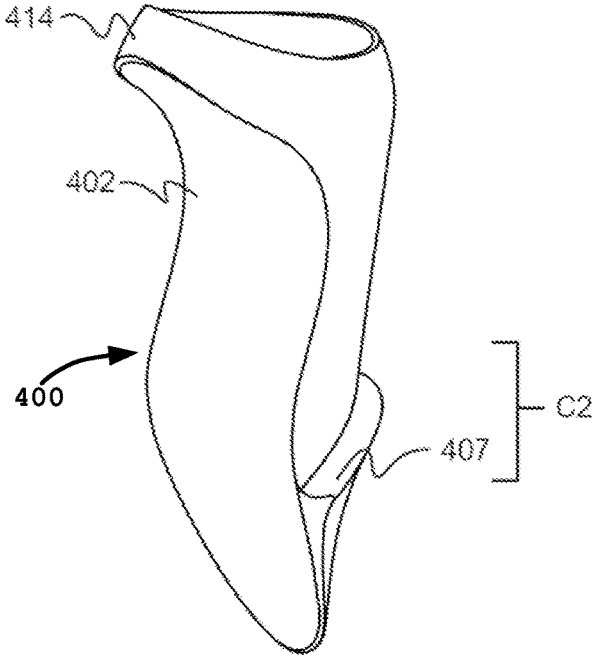
Figure 4C:
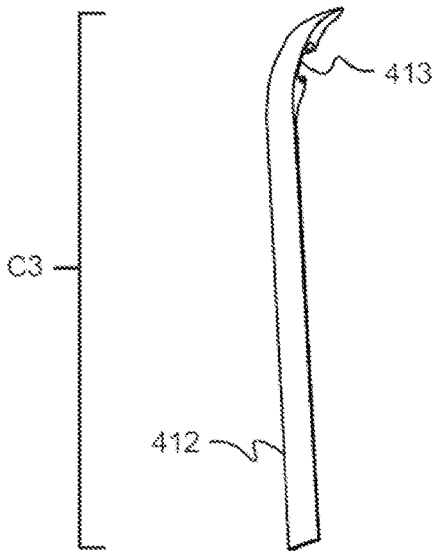
Figure 4D:
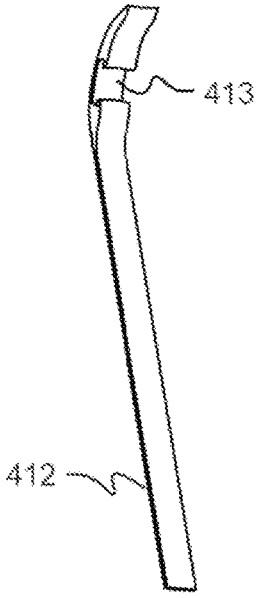

A third example shown in FIGS. 3A-C illustrates an accessory 300 that incorporates a grip portion C2 and a saber guide C3. Accessory 300 includes a body 302 of the same material and in the shape of a hollow shell similar to that of accessory 200 with some exceptions. Notably, body 302 does not include a drip catcher feature, and terminates on the neck or shoulders of the bottle away from the finish of the bottle. A flared end 308 is configured to extend along a first side of a bottle, the flared end 308 including a projecting rim 307 of grip portion C2 for the user's fingers. On an opposing side of the body 302 is an elongated saber guide C3. Saber guide C3 may be formed of a rigid material, such as thermoplastics, metal, wood and the like, and configured as a generally planar or curved arm 312 that lays flat on a side of the bottle. Arm 312 may be formed of a same or different material than the rest of the body. Saber guide C3 may be used to assist in a sabrage, a technique for opening a champagne bottle with a saber, sword, blade, knife, bottom of wine glass, metal credit card, any other suitable thin and hard material, etc. In at least some examples, the grip portion C2 is spaced and sized so that the user places their index, middle, and and/or ring fingers on the grip portion, and their thumb at the bottom of the bottle at the punt of the bottle (see FIG. 3D). With the bottle in hand and retained with the grip portion C2, the user's second hand may glide a blade along the rigid saber guide to break the bottle at a seam between the neck and the lip of the bottle and serve the beverage.

A fourth example shown in FIGS. 4A-D illustrates an accessory 400 that incorporates a coupleable and removable grip portion C2' and a saber guide C3'. Accessory 400 includes a body 402 of the same material and in the shape of a hollow shell similar to those previously discussed. A flared end 408 is configured to extend along a first side of a bottle, the flared end 408 including a projecting rim 407 of grip portion C2' for the user's fingers. A separable, elongated saber guide C3' is provided that may be coupleable to body 402. Saber guide C3' may be formed of a rigid material, such as thermoplastics, metal, wood and the like, and configured as a generally planar or curved arm 412 that lays flat on a side of the bottle. Arm 412 may be formed of a same or different material than the rest of the body. Saber guide C3' may include a transverse channel 413 for coupling to body 402, the transverse channel 413 being sized to receive a fixation portion 414 of body 402 and be made friction frit therewith. Saber guide C3' may be used to assist in a sabrage.

FIGS. 5A-C illustrate another embodiment of a bottle accessory 500. In this example, accessory 500 includes a body 502 having a sidewall 503. Body 502 may be formed of any of the materials discussed above. In this embodiment, body 502 includes a continuous circular collar 505, and the body is extended down a side of the bottle along only one side to include a flared end 508, the body 502 forming a hollow shell or sleeve that complements the shape of a bottle. Flared end 508 may extend down the side of the body close to the bottom of a bottle. In some examples, flared end 508 may circumferentially cover approximately ¼, ⅓, or ½ of a bottle while leaving the rest of the bottle exposed.

In this example, body 502 may incorporate one or more of a plurality of semi-annular rims 507 forming a grip portion D2 adjacent the flared end 508 and projecting out from the body so that a user's fingers can manipulate the bottle. In some examples, rims 507 may project from the body by 1/16, ⅛, ¼, ½, ¾ or 1 inch. In some examples, the rims 507 are curved so that their distal ends closer to the bottom of the bottle, while the midpoint between the distal ends is disposed closer to the collar. Additionally, below annular rims 507, a plurality of arched ribs 509 are shown. In some embodiments, the ribs 509 are arranged in two rows, each row having two ribs 509. It will be understood that rims 507 and/or ribs 509 are optional and that variations are possible that include zero, one or a plurality of each of these elements. Grip portion D2 may allow for the fore, middle, ring, and/or pinky fingers to pull on opposing direction to the thumb which sits in the punt of the bottle to hold the bottle in tension therebetween.

In FIGS. 6A-B, another embodiment of a bottle accessory is shown. Accessory 600 is similar to accessory 500 but is slightly taller to accommodate longer bottles. It will be understood that the length of the accessory, the length of the flared end, the diameter of the collar and other dimensions may be slightly adjusted to accommodate different bottles. Additionally, the body of accessories 500,600 may be formed of a stretchable material to accommodate multiple sizes of bottles.

Although the invention herein has been described with reference to particular embodiments, it is to be understood that these embodiments are merely illustrative of the principles and applications of the present invention. For example, any of the features described above may be used in any combination as desired. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A bottle accessory, comprising:

a body including a collar configured and arranged to sit at least partially about a neck of a bottle, and a flared end extending down at least one side of the bottle, the body including a grip portion comprising a plurality of arched ribs disposed on the flared end.

2. The bottle accessory of claim 1, wherein the body comprises a thermoplastic or thermoset material.

3. The bottle accessory of claim 1, wherein the body comprises silicone.

4. The bottle accessory of claim 1, wherein the collar includes a continuous cylindrical portion.

5. The bottle accessory of claim 1, wherein the grip portion is disposed at a distal end of the flared end.

6. The bottle accessory of claim 1, wherein the grip portion comprises at least one rim projecting out from the body so that a user's fingers can manipulate the bottle.

7. The bottle accessory of claim 6, wherein the at least one rim comprises two rims.

8. The bottle accessory of claim 6, wherein the at least one rim comprises at least one rim angled toward the collar and having a midpoint closer to the collar than distal ends thereof.

9. The bottle accessory of claim 1, wherein the at least one rib comprises a plurality of arched ribs disposed in two rows and two columns.

10. A bottle accessory, comprising:

a thermoplastic or thermoset body including:

a circumferentially continuous collar configured and arranged to sit about a neck of a bottle; and a flared end configured and arranged to extend down one side of the bottle, the flared end including at least one feature forming a grip portion having a plurality of arched ribs.

11. The bottle accessory of claim 10, wherein the grip portion is disposed at a distal end of the flared end.

12. The bottle accessory of claim 10, wherein the grip portion comprises at least one rim projecting out from the body so that a user's fingers can manipulate the bottle.

13. The bottle accessory of claim 12, wherein the at least one rim comprises two rims.

14. The bottle accessory of claim 10, wherein the at least one rib comprises a plurality of arched ribs disposed in two rows and two columns.

15. A bottle accessory, comprising:

a thermoplastic or thermoset body including:

a circumferentially continuous collar configured and arranged to sit about a neck of a bottle; and a flared end configured and arranged to extend down one side of the bottle and to be in direct contact with the bottle all along the flared end, the flared end including at least one feature forming a textured surface having a plurality of gripping elements.

16. The bottle accessory of claim 15, wherein textured surface includes a plurality of raised elements.

* * * * *